US007597200B2

(12) United States Patent
Christensen

(10) Patent No.: US 7,597,200 B2
(45) Date of Patent: Oct. 6, 2009

(54) APPARATUS FOR DRY-DISTRIBUTING OF FIBROUS MATERIALS

(75) Inventor: Kenn Mosgaard Christensen, Risskov (DK)

(73) Assignee: Scan-Web I/S, Risskov (DK)

( * ) Notice: Subject to any disclaimer, the term of this patent is extended or adjusted under 35 U.S.C. 154(b) by 0 days.

(21) Appl. No.: 10/182,435

(22) PCT Filed: Jan. 26, 2001

(86) PCT No.: PCT/DK01/00055

§ 371 (c)(1),
(2), (4) Date: Jul. 29, 2002

(87) PCT Pub. No.: WO01/54873

PCT Pub. Date: Aug. 2, 2001

(65) Prior Publication Data

US 2003/0010683 A1 Jan. 16, 2003

(30) Foreign Application Priority Data

Jan. 28, 2000 (DK) ..... 2000 00142

(51) Int. Cl.
*B07B 1/24* (2006.01)

(52) U.S. Cl. ..... 209/295; 209/289; 209/37; 209/139.1

(58) Field of Classification Search ..... 209/36, 209/37, 138, 139.1, 154, 289, 294, 295, 407; 19/144, 145, 145.3, 145.5, 145.7, 305–308; 425/80.1, 81.1, 82.1, 83.1; 264/121, 517, 264/518

See application file for complete search history.

(56) References Cited

U.S. PATENT DOCUMENTS

| | | | | | |
|---|---|---|---|---|---|
| 500,102 | A | * | 6/1893 | Moran | 19/44 |
| 4,352,649 | A | * | 10/1982 | Jacobsen et al. | 425/83.1 |
| 4,375,448 | A | * | 3/1983 | Appel et al. | 264/518 |
| 4,640,810 | A | * | 2/1987 | Laursen et al. | 264/518 |
| 5,733,450 | A | * | 3/1998 | Langner | 210/403 |
| 5,885,516 | A | * | 3/1999 | Christensen | 264/518 |

FOREIGN PATENT DOCUMENTS

| | | |
|---|---|---|
| EP | 0 032 772 | 7/1981 |
| EP | 0 345 234 | 12/1989 |
| WO | WO 81 02031 | 7/1981 |
| WO | WO 86 00097 | 1/1986 |
| WO | WO 87 01403 | 3/1987 |

* cited by examiner

*Primary Examiner*—Patrick H Mackey
*Assistant Examiner*—Mark Hageman
(74) *Attorney, Agent, or Firm*—Browdy and Neimark, P.L.L.C.

(57) ABSTRACT

An apparatus for formation of a course of fibrous materials on a perforated forming wire mesh with an underlying suction box and an overlying fiber distribution box, in which a pair of rotating, perforated drum cylinders are provided for the delivery of a stream of air-fluidised fiber, which is then flung out down on to the wire mesh by the drawing-down of air by the suction box from the upper end of the distribution box, cover plates (18) is arranged at a distance below the upper level of the drum cylinders, which plates substantially shield-off the free flow of air down through the vertical spaces between the drums themselves and between the drums and the adjacent side walls of the distribution box.

1 Claim, 1 Drawing Sheet

APPARATUS FOR DRY-DISTRIBUTING OF FIBROUS MATERIALS

BACKGROUND AND SUMMARY

The present invention relates to an apparatus for dry-distributing of fibrous materials for the formation of a course of fibrous material, and more specifically an apparatus of the type which is disclosed in EP-C-0032 772 (DK Patent No. 149979). The apparatus has a forming head which is disposed immediately above a moving wire mesh, under which there is a suction box for the creation of a downwards-leading flow of air in the forming head. This head is configured as a bottomless and top-less box which extends transversely to the wire mesh and contains a pair of parallel, rotatable drums consisting of perforated plates. At their respective opposing ends, these drums are flow-connected by means of channel bends at 180°, and through the one or the both of these there is blown a stream of air-fluidised fibre which thus circulates axially through the drums.

A part of the air from the suction box that is sucked down through the forming box will pass transversely through the perforated drums, and herewith have a leading-out effect on the fibres, which is supported by the rotation of the drums, which in themselves have a slinging-out effect on the air and herewith on the fibres in the drums. It has been ascertained that with this technique an advantageous distribution of the fibres can be achieved over both the length as well as the breadth of the wire mesh, as well as a quite high capacity for the plant.

In the handling of air-fluidised fibre, problems can easily arise with regard to static electricity, which can not only promote the formation of clumps in the fibres, but can also lead to the attraction of fibre clumps towards the swept surfaces such as the inner sides of said forming box. Therefore, with the relevant technique it is advantageous that a second part of the sucked-down air is brought to flow down into the clearance arising between the pair of drums and the inner sides of the forming box, in that this air can thus remove fibres and small clumps of fibres which adhere to these side surfaces.

However, with the present invention it has been realised that these conditions can be changed considerably by a modification which in principle is quite simple, namely that by means of upper cover plates, a covering can be established of the slot spaces between upper, upwardly-exposed parts of the drum cylinders, and respectively between the drum cylinders, and the spaces between these parts and the adjacent inner sides of the forming box. This would immediately appear to be controversial, the reason being that precisely the sluicing effect which the sucked-down air exercises on the inner sides of the forming box would, after all, be annulled, but the modification must be seen primarily in the light that it will force all the air which is sucked down to pass down through the drums, which will radically change the operational conditions.

Firstly, the dosing-out capacity of the drums will be increased to a particularly distinct degree, typically by no less than 60-70%. Secondly, the emission of air/fibre from the lower parts of the drums will be so intensified that this emission in itself can counteract the mentioned accumulation of fibres on the inner side of the forming box. The same will apply to a possible accumulation of fibres on the outer side of the drum cylinders around their perforations, as the fibres will be blown out through these openings with greater force than has hitherto been the case, and thus it is a realistic possibility to be able to completely avoid the arranging of hitherto-necessary means such as rotating brush rollers for the cleaning of the outer sides of the drum cylinders.

Moreover, it has proved that the improved result can be achieved while using a reduced suction effect, i.e. with a reduced consumption of energy.

BRIEF DESCRIPTION OF THE DRAWING

The invention is illustrated by way of example in FIG. 1, which shows an apparatus with the same basic configuration as that which is disclosed in EP.C-0332772.

DETAILED DESCRIPTION

Figure 1:
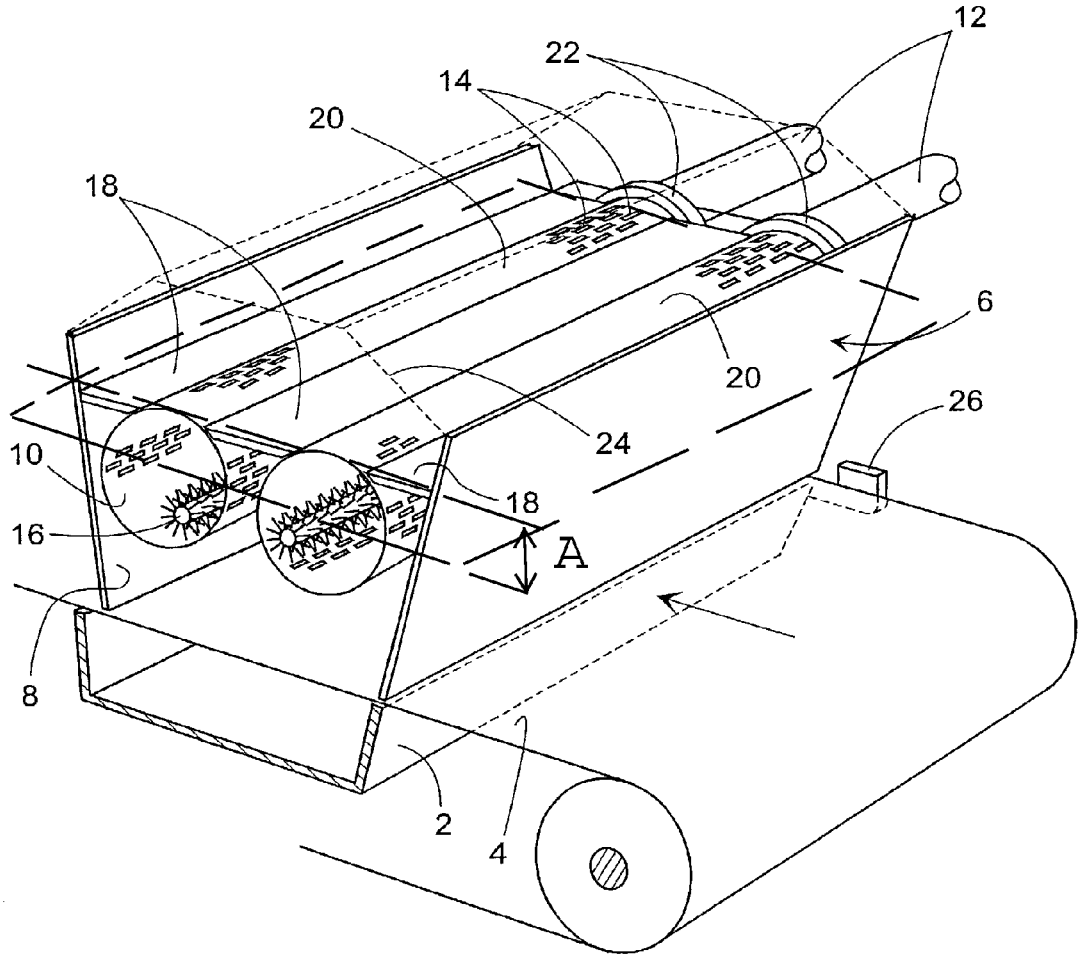

The apparatus comprises a suction box 2 underneath a perforated forming wire mesh 4, and above this a forming head 6 in the form of a box 8 which is open down towards the wire mesh 4, in which box there extends a pair of perforated drums 10 which are suspended in a manner in which they can rotate, and with connections 12 at their ends. Via not-shown U-pipe-bends, the drum cylinders 10 form a circulation system in which a fibre-loaded stream of air supplied from the one or both ends of the pair of cylinders can circulate during the leading out of air and fibre through the perforations 14 in the cylinder walls. In order to keep the fibres well agitated inside the drum cylinders, in each of these there is housed a quickly-rotating needle roller 16.

As described so far, the apparatus is known, i.e. the air is sucked down to the suction box 2 not only down through the perforated drums 10 but also down through the respective spaces around said drums.

According to the invention, near the upper side level of the drum cylinders 10, i.e., in an area at a level between an upper horizontal tangential plane (shown in dashed lines of FIG. 1) of the perforated drums, and slightly down below this level, i.e., above a horizontal diametrical plane (shown in dashed lines of FIG. 1) of the perforated drums, cover plates 18 are provided which shield off the said space outside these cylinders, so that all of the air to the suction box 2 is now sucked down through the upper, exposed wall parts 20 of the cylinders 10. This will result in a more concentrated emission of fibre directly down towards the wire mesh. In other words, the cover plates 18 are provided in the area A shown in FIG. 1.

With plants having a broad track, special arrangements will normally be required to achieve the desired degree of sealing between the drum cylinders 10 and the edges of the plates 18, e.g. a mounting of the drum cylinders in ball bearings 22. The slots do not need to be closed completely, but the more closed they are the more the efficiency increases.

It shall be mentioned that with the invention it will be advantageous to work with increased air pressure in a limited space 24 above the plates 18, possibly in connection with a recirculation of the suction air.

It has been customary to make use of a net of bronze wire for the forming wires 4, and it is well-known that these wires must be guided quite precisely with regard to their direction of movement by means of sensor-controlled, adjustable reversing rollers, in that they can not tolerate a crooked running in such a way that they abut with their side edges up against limiting surfaces for the transverse position. In connection with the invention it has now been ascertained that by use of a wire of plastic material, it is possible to avoid the expensive control arrangement, in that such a wire can withstand transverse control simply by contact up against fixed side guides, e.g. as shown at 26.

The invention claimed is:

1. An apparatus for dry-distributing fibre materials in the formation of a course of fibre material on a moving forming wire mesh, comprising:

a suction box disposed under said wire mesh, a forming head disposed above the wire mesh in the form of an elongated box extending transversely to the wire mesh, and which has an air inlet at the top and is open down towards the wire mesh, and which contains a pair of rotating, perforated drums from which at least one of their ends a stream of air-fluidised fibre is supplied, and cover plate parts (18) disposed in an upper space of the forming head, in an area at a level between a horizontal diametrical plane of the perforated drums and an upper horizontal tangential plane of the perforated drums, for substantial shielding-off of the down-flow of inlet air to the slot areas respectively between the drums and between the drums and the adjacent walls of the box, thereby increasing the concentration of the air supply directly down through the drums.

* * * * *